United States Patent [19]

Sakauye et al.

[11] 4,297,866

[45] Nov. 3, 1981

[54] ASYMMETRICAL SHAPING OF SLIT SEGMENTS OF MESHES FORMED IN DEFORMABLE STRIP

[75] Inventors: Randall T. Sakauye, Mississauga; John V. Marlow, Oakville; Gordon H. Laurie, Mississauga; Theodore J. Seymour, Oakville, all of Canada

[73] Assignee: Cominco Ltd., Vancouver, Canada

[21] Appl. No.: 77,080

[22] Filed: Sep. 19, 1979

[30] Foreign Application Priority Data

Aug. 1, 1979 [CA] Canada ..... 333003

[51] Int. Cl.[3] ..... B21D 31/02

[52] U.S. Cl. ..... 72/186; 29/6.1; 428/597

[58] Field of Search ..... 72/186; 29/6.1, 163.5 R, 29/2; 113/116 A; 428/596, 597

[56] References Cited

U.S. PATENT DOCUMENTS 3,760,470 9/1973 Feisenthal ..... 29/6.1

*Primary Examiner*—Lowell A. Larson

*Attorney, Agent, or Firm*—Arne I. Fors; Robert F. Delbridge

[57] ABSTRACT

A method of forming elongated slit segments in deformable strip includes concurrently slitting and preforming the strip by intermeshing substantially convexly shaped tool surfaces each having a linear leading portion and a linear trailing portion joined by a rounded apex portion. The linear leading and trailing portions are collinear with and generally define portions of the sides of a triangle which has a base with a length equal to the length of the strip being slit. The length of the side of the triangle corresponding to and collinear with the leading portion is less than the length of the side of the triangle corresponding to and collinear with the trailing portion, and the angle formed between the side of the triangle corresponding to the leading portion and the base is not greater than 90°.

12 Claims, 18 Drawing Figures

ASYMMETRICAL SHAPING OF SLIT SEGMENTS OF MESHES FORMED IN DEFORMABLE STRIP

BACKGROUND OF THE INVENTION

The present invention relates to an improvement in the shaping of slit segments of meshes formed in deformable strip and, in particular, relates to an improvement in the method and apparatus of copending Canadian Patent Application No. 315,190 filed Oct. 31, 1978 wherein a concurrent slitting and preforming operation provides a plurality of longitudinally extending strand-like components comprising segments elongated by deformation out of the plane of the strip and unslit segments retained in the plane of the strip. The unslit segments together define continuous bands extending laterally across the portion of strip contained between longitudinally extending edge portions of strip. In a second slitting step, the slits are extended in a staggered relation to permit lateral expansion of the slit portion of the strip. Opposite longitudinally extending edges of the strip are then drawn apart to expand the slit and preformed strip to form sheet having a network of meshes which are substantially in the plane of the sheet. Because of the holding of the bands containing all the bonds which connect adjacent components during slit segment elongation, desired elongation of the slit segments as they are formed is achieved while rupture of the strands during mesh expansion or failure of the strands at node bonds is substantially avoided.

In known methods for elongating slit segments so that mesh areas do not become shorter than unslit borders on lateral expansion, e.g. the preforming of wires from strip having conventionally staggered rows of slit as in U.S. Pat. No. 1,212,963, the wires are shaped against symmetrically contoured tool faces. This patent is directed to the production of metal lath, and it is unlikely that stretching of the wires during preforming of metal suitable for this purpose would cause localized weakening that may affect their usefulness.

STATEMENT OF INVENTION

In the preforming of slit segments of materials having low tensile strengths, e.g. lead or lead alloys, we have observed that areas of weakness occur near the trailing ends of slit segments as the strip is advanced at high speeds through the slitting and preforming assembly. We have determined that the slit segments are more uniformly stressed if substantially convexly shaped tool surfaces used to deform slit segments out of the plane of the strip are asymmetrically shaped with the distances between their apices and their respective leading ends which enter the strip being less than the distances between their apices and their trailing ends.

The method of our invention for forming elongated slit segments in deformable strip comprises, in general, concurrently slitting and preforming said strip by intermeshing, substantially convexly shaped tool surfaces each having a linear leading portion and a linear trailing portion joined by a rounded apex portion, said linear leading and trailing portions collinear with and generally defining portions of the sides of a triangle having a base wherein said base has a length equal to the length of the strip being slit and the length of the side of the triangle corresponding to and collinear with the leading portion is less than the length of the side of the triangle corresponding to and collinear with the trailing portion and the angle formed between the side of the triangle corresponding to the leading portion and the base is not greater than 90°.

More preferably, the length of the linear leading portion is less than the length of the linear trailing portion within the range of relative ratios of 1:1 to 1:10 and the angle formed between the side of the triangle corresponding to the leading portion relative to the base is in the range of from about 30° to about 85°.

The apparatus of our invention comprises a pair of opposed rolls each having a plurality of equispaced discs having circumferential, equally spaced, convexly shaped tool surfaces alternating with substantially flat surfaces whereby peripheral surfaces of opposing rolls are adapted to interact on strip passing therebetween to slit and preform segments in said strip by intermeshing of said convexly shaped tool surfaces and define continuous lateral unslit bands by said substantially flat surfaces, said convexly shaped tool surfaces each having a linear leading portion and a linear trailing portion joined by a rounded apex portion, said linear leading and trailing portions collinear with and generally defining the sides of a triangle having a base wherein said base has a length equal to the length of the strip being slit and the length of the side of the triangle corresponding to and collinear with the leading portion is less than the length of the side of the triangle corresponding to and collinear with the trailing portion and the angle formed between the side of the triangle corresponding to the leading portion and the base is not greater than 90°.

BRIEF DESCRIPTION OF THE DRAWINGS

Development of preferred tool surface shapes will now be described in detail, reference being made to the accompanying drawings, wherein:

FIGS. 5 to 13 are plans of proportionately enlarged tooled peripheral surfaces used in the apparatus of FIG. 4 and outlines of deformed plastic strip provided thereby wherein:

FIG. 5 relates to a symmetrical circle-based tool surface;

FIG. 6 relates to a rectangle-based tool surface;

FIG. 7 relates to a modified rectangle-based tool surface;

FIG. 8 relates to a first modification of a symmetrical triangle-based tool surface;

FIG. 9 relates to a second modification of a symmetrical triangle-based tool surface;

FIG. 10 relates to a first modification of an asymmetrical triangle-based tool surface;

FIG. 11 relates to a second modification of an asymmetrical triangle-based tool surface;

FIG. 12 relates to a third modification of an asymmetrical triangle-based tool surface;

FIG. 13 relates to a fourth modification of an asymmetrical triangle-based tool surface;

DESCRIPTION OF THE PREFERRED EMBODIMENTS

Figure 1:
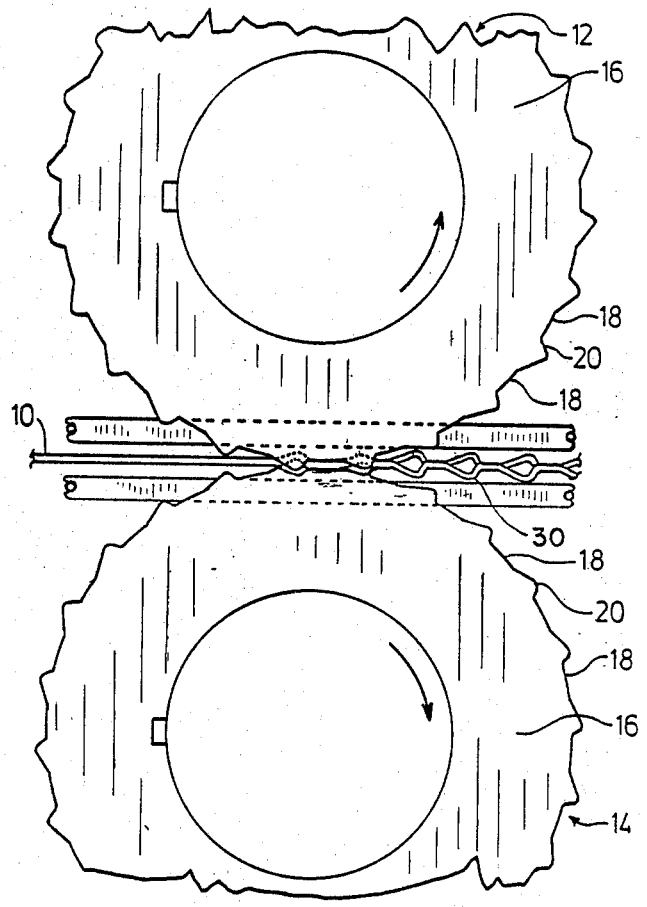
FIG. 1 is a side elevation showing engagement of slitting and preforming rolls of the invention used to provide elongated slit segments.
Figure 2:
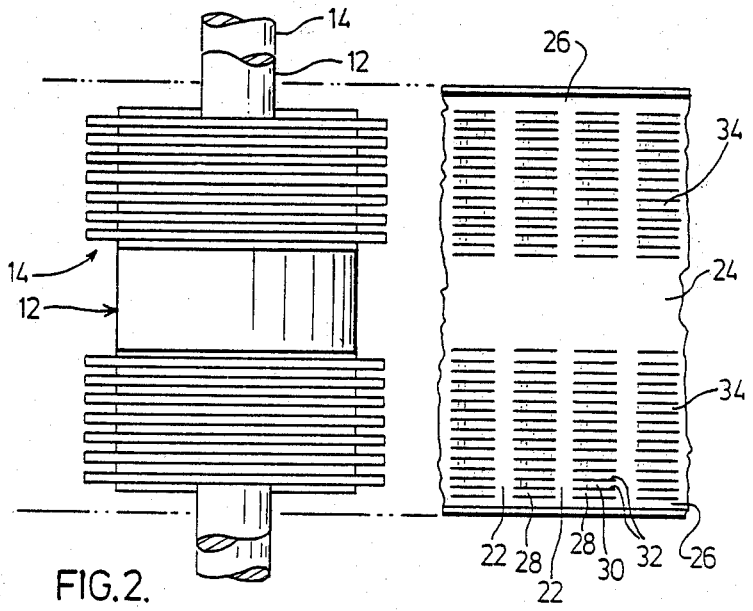
FIG. 2 is a plan of the slitting and preforming rolls of FIG. 1 showing strip after passing therethrough.
Figure 3:
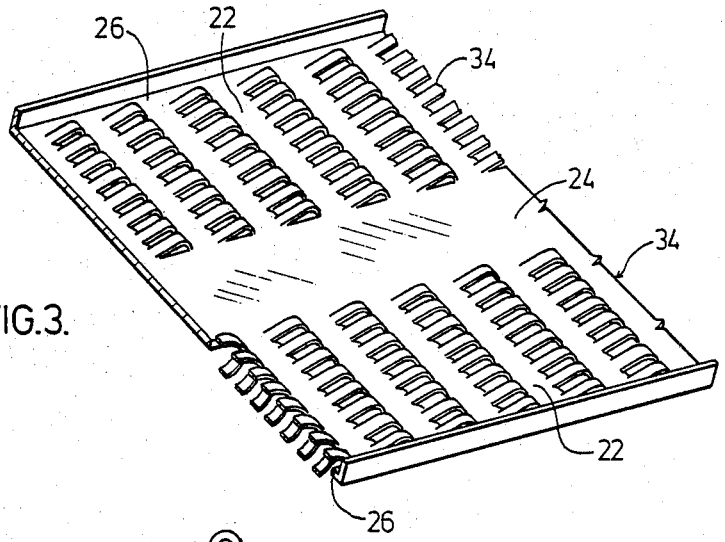
FIG. 3 is a perspective view, partly cut away, of the said strip as it leaves the slitting and preforming rolls of FIGS. 1 and 2.

As shown in FIGS. 1 and 2, strip 10 passes between coacting rolls 12 and 14. Each roll has a plurality of spaced discs 16, each disc having tooled peripheral surfaces comprising alternating relatively flat equispaced portions 18 and substantially convexly shaped portions 20. As the discs rotate, flat portions 18 engage strip 10 to hold strip bands 22 extending between a central portion 24 of the strip and lateral portions 26 in the plane of the strip while substantially convexly shaped tool surface portions 20 intermesh and overlap to slit areas 28, which are between bands 22, and deform segments 30 which are between pairs of slits 32 out of the plane of the strip. Slit segments 30 are elongated an amount sufficient to compensate for shortening of mesh portions 34 which contain the slit segments as slits 32 are extended in a staggered relation and lateral portions 26 of the strip are moved apart in subsequent steps, as disclosed in copending Canadian Patent Application No. 315,190, to provide open meshes in the plane of the strip. The amount of elongation required depends on the size of the slit end angles required in the open meshes. For example, for slit end angles of 70° for typical battery grids, elongations of about 22 percent are required. Therefore, the lengths of tool surfaces 20 used in the following tests were 22 percent greater than the length of material being slit in areas 28, unless otherwise noted.

Preliminary tests in the slitting and preforming of strip and in the lateral expansion of this strip to form expanded mesh sheet indicated that less damage to slit segments and connecting nodes occurred when the substantially convexly shaped portions 20 of the tooled peripheral surfaces of spaced discs 16 were asymmetrically shaped with their apices in advance of the centre line between the entry and trailing ends of tool faces 20, i.e., closer to the leading ends than to the trailing ends of the tool faces. In order to define more clearly the form of this asymmetry, test apparatus 36, FIG. 4, was made to determine on an enlarged scale the effects on slit and preformed strip of tool surfaces having different shapes. Circle-, rectangle- and triangle-based shapes were tested. Linear dimensions were enlarged to five times those of discs 16 when used to slit and preform 1.27 mm thick metal strip.

Figure 4:
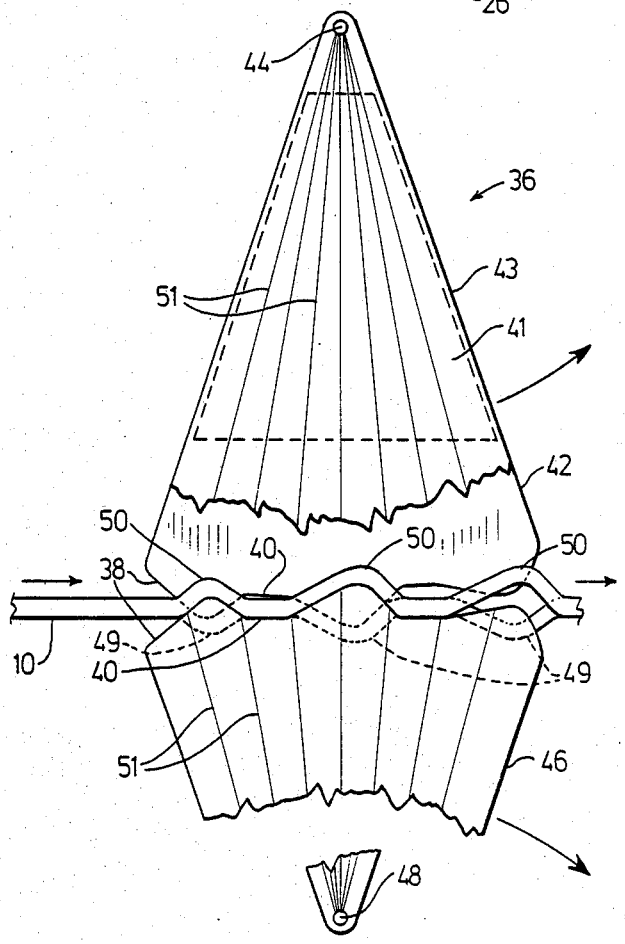
FIG. 4 is a plan of apparatus used to simulate, on an enlarged scale, movement of deformable plastic strip through slitting and preforming rolls wherein one tool surface modification is shown.

For each shape shown in FIGS. 5 to 13, three pieces of 6.35 mm thick hard plastic sheet were prepared with each having three lobes 38 with tooled surfaces corresponding to convexly shaped portions 20 spaced by two node areas 40 corresponding to relatively flat portions 18 of the peripheral surfaces of discs 16. Two pieces 41 and 42 were bolted together with the prepared faces aligned and with a 6.35 mm spacer in between to provide an assembly 43 which simulates a pair of adjacent discs 16 of roll 12 and which was adapted to rotate about centre 44. The third piece, 46, having a support space of 6.35 mm thickness, not shown, was adapted to rotate about centre 48 with its lobes 38 moving in circumferential alignment between corresponding lobes 38 of the pieces of sheet making up assembly 43. Centres 44 and 48 were spaced to permit 6.35 mm thick extruded plasticine strip to be passed through the opening between engaging faces of assembly 43 and piece 46, with flat surfaces 40 holding portions of the strip corresponding to bands 22 as lobes 38 engaged to slit and preform portions corresponding to portions 28 between bands 22. For convenience, the apparatus was mounted on a table to provide support for the plasticine strip and to permit horizontal rotation during slitting and preforming. In FIG. 4, formation of elongated segments 49 by action of lower piece 42 of assembly 43 and formation of an adjacent, overlying line of elongated segments 50 by action of piece 46 are shown. For clarity of illustration, elongated segments 49 formed by partially cut away upper piece 41 are not shown. Synchronization of the rotation of assembly 43 and piece 46 was facilitated by inscribing equally spaced radial lines 51 on each and maintaining circumferential alignment of corresponding lines during rotation. FIG. 4 illustrates apparatus 36 wherein the asymmetrical triangle-based tool faces of FIG. 10 were used. Like apparatus with corresponding tool faces was used for each of the shapes shown in FIGS. 5 to 13. Reference will now be made to each of the lobe shapes tested and to corresponding elongated segments of plasticine. In Table 1, dimensions chosen for tool lobes were based on slitting and preforming of 8.81 mm wide areas 28 spaced between 3.18 mm wide bands 22 of strip 10. Unless otherwise stated, the length of the preforming face extending from the leading end to the trailing end of each lobe 38 was 122 percent of 8.81 mm. This length comprised the sum of the lengths of any curved or linear parts. Curved portions were arcs of circles having arbitrarily chosen radii as shown in Table 1. Dimensions were determined mathematically with computer aid in the solution of more complex equations, to be described below. These dimensions were multiplied by 5 to get the dimensions used in the test apparatus, i.e., the peripheral surfaces had flat 15.90 mm long node portions 40 spaced by 44.05 mm long chords, the ends of which were the leading and trailing ends of preforming lobes 38.

TABLE 1

| | Lobe Shapes Studied | | | |
|---|---|---|---|---|
| Figure | Basic Shape | Description | Arc Radii mm | Triangle Side Ratio Leading:Trailing |
| 5 | circle arc | — | 5.02 | — |
| 6 | rectangle | symmetrical | 1.70 | — |
| 7 | rectangle | one arc, one slope | 1.70 | — |
| 8 | triangle | symmetrical | 1.98 | 1:1 |
| 9 | triangle | symmetrical | 3.18 | 1:1 |
| 10 | triangle | asymmetrical | 1.98 | 1:1.5 |
| 11 | triangle | asymmetrical | 3.97 | 1:1.5 |
| 12 | triangle | asymmetrical | 1.98 | 1:2.5 |
| 13 | triangle | asymmetrical | 3.18 | 1:2.0 |
| 14 | triangle | asymmetrical | 1.98 | 1.5:1 |
| 15 | triangle | asymmetrical | 3.97 | 1.5:1 |
| 16 | triangle | asymmetrical | 1.98 | 2.5:1 |
| 17 | triangle | asymmetrical | 3.18 | 2.0:1 |

Figure 5:
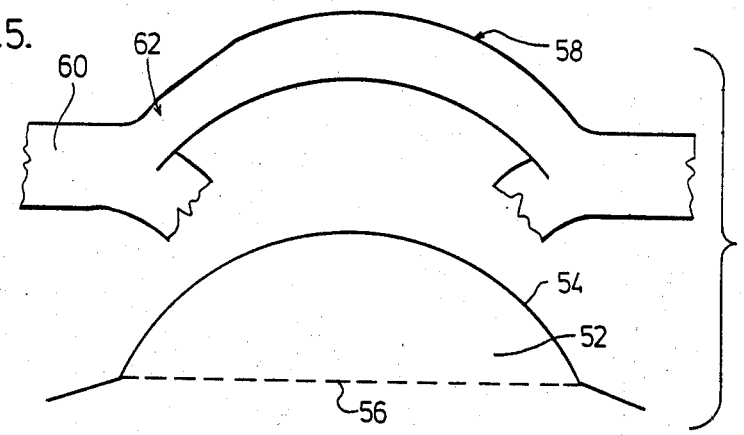

In the test illustrated by FIG. 5, preforming lobe 52 was a segment of a circle wherein arc 54 was 22 percent longer than chord 56 which represents, on an enlarged scale, the 44.05 mm length of material from which elongated segment 58 was formed from plasticine strip 60. Trailing end 62 of segment 58 shows more thinning than the remaining part of the segment. This is typical when slitting and preforming are done with rolls having circle-based lobes.

Figure 6:
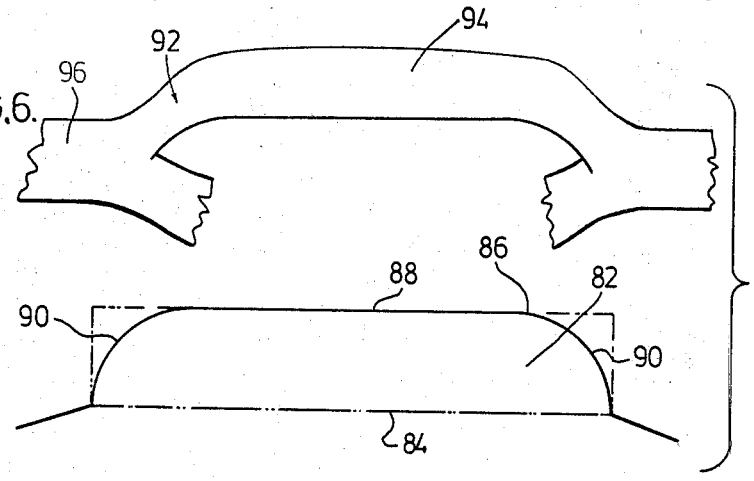

In the test illustrated by FIG. 6, lobe 82 was based on a rectangle having base 84 corresponding to the width of area 28 being slit. Tool surface 86, having a length 22 percent longer than base 84, comprised linear portion 88 on the opposite side of the rectangle and two circular end portions 90 which were shaped to approach the rectangle sides tangentially. Portions of the rectangle not comprising tool surface 86 are shown by broken lines. Excessive localized thinning occurred in trailing portion 92 of elongated segment 94 of strip 96.

Figure 7:
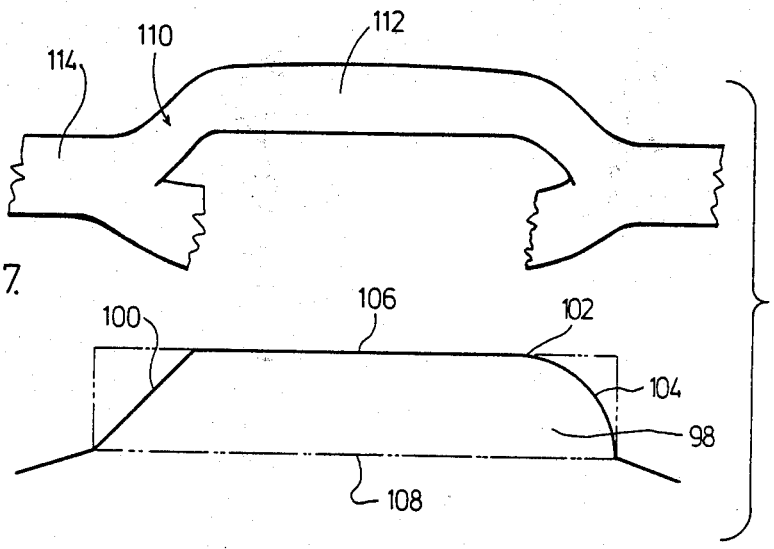

FIG. 7 shows a modified rectangle-based lobe 98 wherein the trailing circle segment of FIG. 6 was replaced by a 45° bevelled portion 100. Tool surface 102, comprising arc portion 104, linear portion 106 and bevelled portion 100 was only 119 percent of the length of base 108. Localized thinning as shown in trailing portion 110 of elongated segment 112 of strip 114 was not as great as with the circular trailing segment formed by lobe 82.

Figure 8:
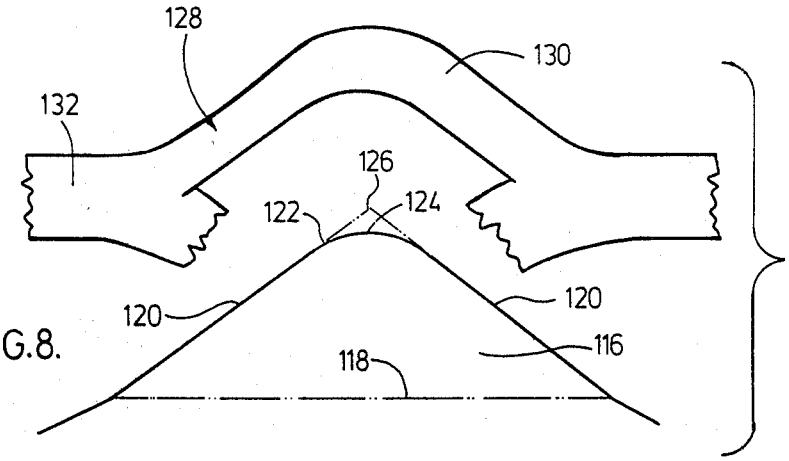

Lobe 116 of FIG. 8 was based on a symmetrical triangle wherein base 118 was 44.06 mm, the length of plasticine strip being slit. Linear portions 120 of slitting and preforming face 122 were joined by a circular apex portion 124 which met the linear portions tangentially. Extension of linear portions 120, by broken lines, to vertex 126 completes the triangle. The radius of apex portion 124 was 9.90 mm, i.e., 5 times the radius shown in Table 1 for the shaping of lead strip. Trailing portion 128 of elongated segment 130 of plasticine strip 132 showed greater thinning than the rest of the segment.

Figure 9:
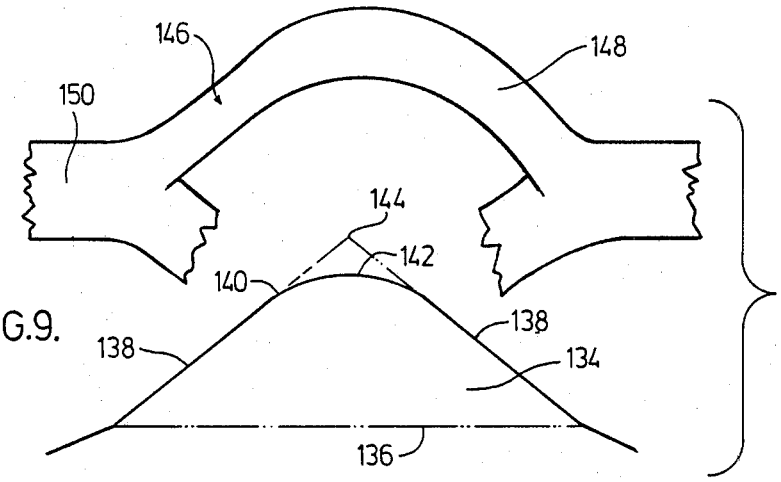

Lobe 134 of FIG. 9 was also based on a symmetrical triangle, with line 136 representing the length of material being slit. Linear portions 138 of slitting and preforming face 140 were joined by circular apex portion 142 which met the linear portions tangentially. Broken lines meeting at vertex 144 complete the triangle. In this example, the radius of apex portion 142 was 15.90 mm, i.e., greater than that shown in FIG. 8. Trailing portion 146 of elongated segment 148 of strip 150 showed less uniform distribution of thinning along the length of the trailing portion of segment 148 than was obtained with the smaller radius apex shown in FIG. 8.

FIGS. 10 to 13 represent tests with a group of four triangle-based lobes having slitting and preforming surfaces comprising linear leading and trailing portions which were parts of sides of asymmetrical triangles and circular arc portions meeting the linear portions tangentially near the triangle vertex at which the sides intersected. Tests were made with three triangle side ratios wherein the ratios of leading side of triangle to trailing side of triangle $<1:1$.

Three circular arc radii were also tested. Because of this asymmetry, the apex of each lobe was in advance of the centre line between the leading and trailing ends of the lobe, i.e., the apex was closer to the leading end than to the trailing end of the lobe.

Figure 10:
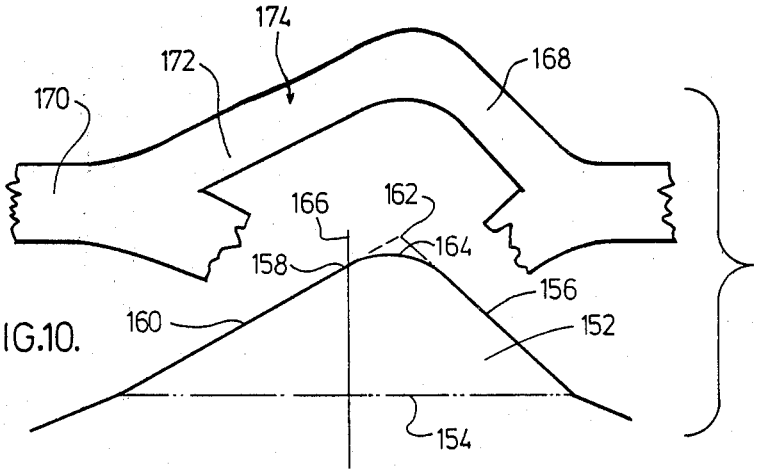

In lobe 152 of FIG. 10, triangle base 154 was 44.6 mm, the length of plasticine strip being slit. Leading linear portion 156 of slitting and preforming face 158 was shorter than trailing linear portion 160, their lengths being fixed by the length of base 154, predetermined 22 percent elongation, a selected ratio of leading side to trailing side equal to 1:1.5 for the correspoinding collinear sides of the triangle having vertex 162, and choice of a circular arc apex portion 164 having a 9.92 mm radius. This radius was about 23 percent of the length of base 154. Apex 164 was in advance of centre line 166 between the leading and trailing ends of the lobe. With this shape, more uniform thinning of preformed segment 168 of strip 170 was obtained than with all the other shapes tested. It may be noted that trailing portion 172 was generally uniformly thinned throughout its length, with slightly greater thinning in central part 174.

Figure 11:
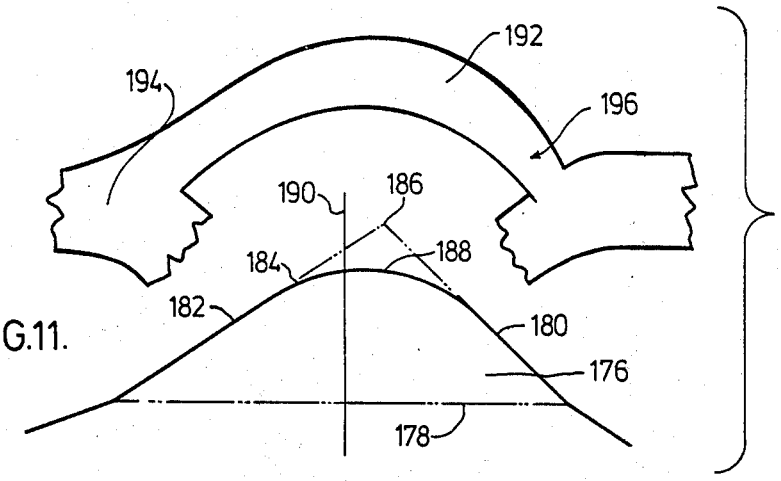

In lobe 176 of FIG. 11, triangle base 178 was the length of plasticine strip being slit. Leading linear portion 180 and trailing linear portion 182 of slitting and preforming face 184 were collinear with the sides of a triangle intersecting at vertex 186 and having base 178. As in FIG. 10, the ratio of the lengths of the sides of this triangle was 1:1.5. However, the radius of circular arc apex portion 188 was 19.85 mm, twice that of the arc of the FIG. 10 lobe and about 45 percent of the length of triangle base 178. As before, triangle vertex 186 and the apex of arc 188 were in advance of centre line 190. Severe thinning of preformed slit segment 192 of strip 192 occurred at the leading end, i.e., in portion 196. This thinning will be discussed after FIGS. 12 and 13 are described.

Figure 12:
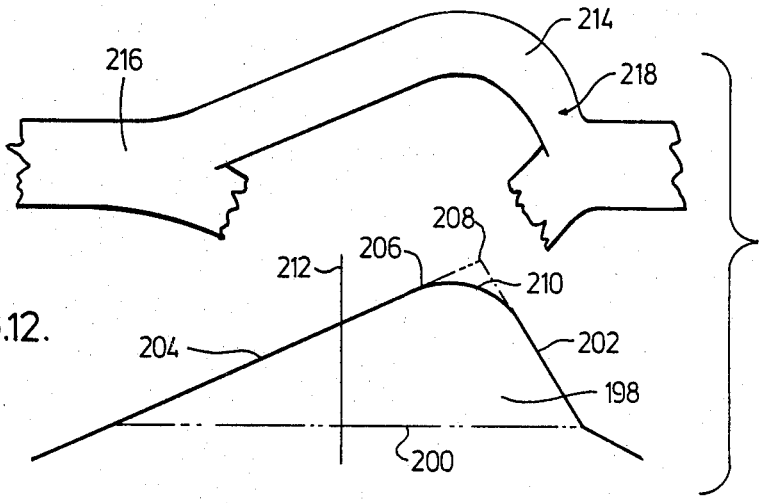

In lobe 198 of FIG. 12, triangle base 200 was the length of material being slit. Leading linear portion 202 and trailing linear portion 204 of slitting and preforming face 206 were collinear with the sides of a triangle intersecting at vertex 208 and having base 200. The lengths of the sides of the triangle were in the ratio of leading side to trailing side equal to 1:2.5. The radius of circular arc apex 210 was 9.92 mm, the same as in FIG. 10. Triangle vertex 208 and the apex of arc 210 were in advance of centre line 212. More thinning of corresponding slit segment 214 of strip 216 occurred at the leading end, i.e., in part 218, than in the rest of the segment.

Figure 13:
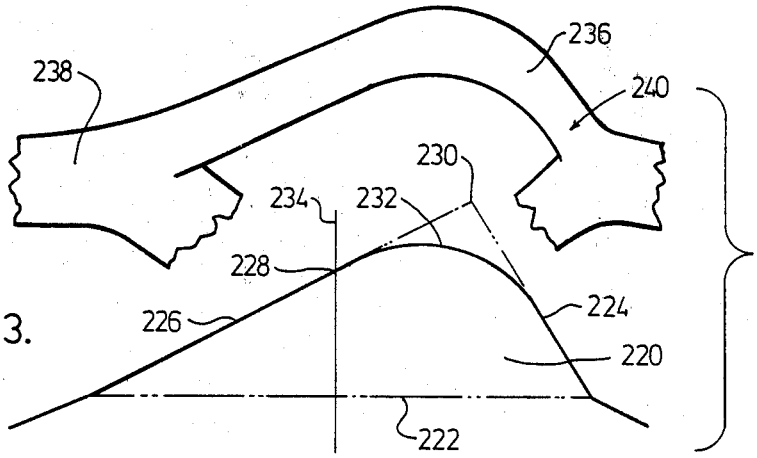
Figure 14:
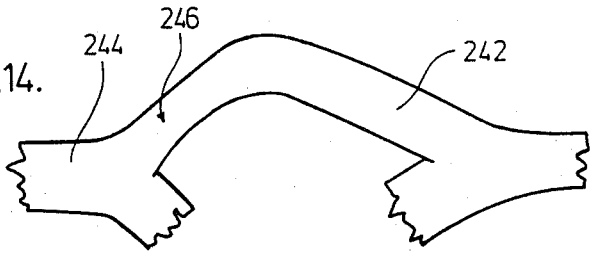
FIGS. 14 to 17 are outlines of deformed plastic strip formed by inverting tool portions of the apparatus of FIG. 4 to observe the effects of reverse rotation of the tool surfaces of FIGS. 10 to 13, respectively.
Figure 15:
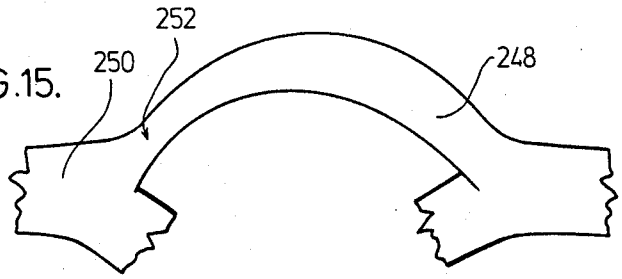
Figure 16:
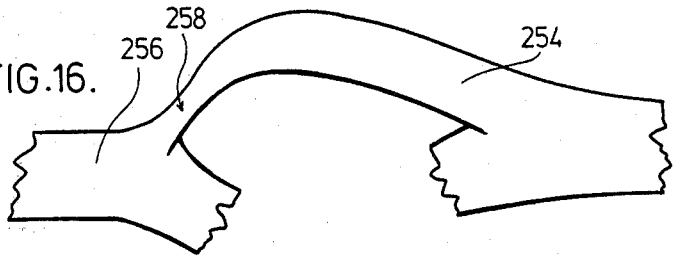
Figure 17:
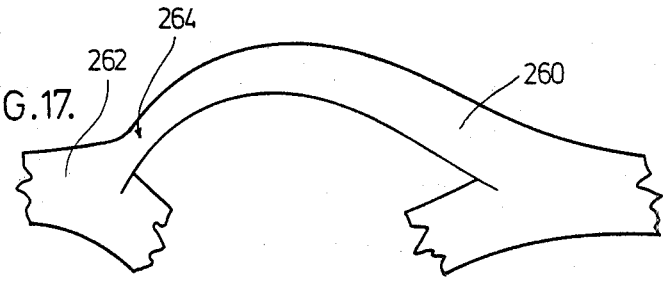

In lobe 220 of FIG. 13, triangle base 222 was the length of material being slit. Leading linear portion 224 and trailing linear portion 226 of slitting and preforming face 228 were collinear with sides of a triangle intersecting at vertex 230 and having base 222. The lengths of the sides of the triangle were in the ratio of leading side to trailing side equal to 1:2.0. The radius of circular arc apex portion 232 was 15.88 mm, i.e., intermediate the 9.92 mm and 19.84 mm radii of the arc portions of FIGS. 10 and 11, respectively. The radius was about 36 percent of the length of triangle base 222. Triangle vertex 230 and the apex of arc 232 were in advance of centre line 234. As in FIGS. 11 and 12, most of the thinning of corresponding slit segment 236 of strip 238 occurred at its leading end, in portion 240. Comparison of FIGS. 11, 12 and 13 indicates that leading end thinning becomes more severe as the radius of the lobe apex increases.

FIGS. 14 to 17 illustrate slit and preformed segments obtained by reversing the direction of rotation of the parts of apparatus 36, with the effect that trailing portions shown in FIGS. 10 to 13 became leading portions. For convenient comparison with FIGS. 10 to 13, the drawings are rotated so that the portions of strip formed by the leading ends of the lobes are to the right. Tool lobes, being the same as in FIGS. 10, 11, 12 and 13 respectively, are not shown in FIGS. 14, 15, 16 and 17. All the drawings illustrate rotation which provides left to right movement of the lobes in the engagement area with left to right movement of strip between lobes. Lobe data for this reverse shaping of slit segments are given in the table. In each case severe thinning occurred at the trailing end of the segment. Elongated segments 242, 248, 254 and 260 of strips 244, 250, 256 and 262 showed excessively thin portions 246, 252, 258 and 264. Increasing the leading end to trailing end ratio and increasing the radius of the apex both contributed to more severe localized thinning.

It will be understood that the preceding description and data pertaining to the ratios of the length of the side of the triangle corresponding to the linear leading portion of the tool surface relative to the linear trailing portion relate to a 22 percent elongation of slit segments and it is understood that preferred ratios can vary according to desired percentage elongation, characteristics of the metal alloy formed such as hardness and tensile strength, and thickness of the metal strip. We have found that a range of ratios of from 1:1 to 1:10 is satisfactory for elongations such as 5 percent elongation of lead alloy slit segments with, for example, a leading angle of about 65° between the triangle side collinear with the leading linear portion of the tool surface and the triangle base. In order to provide greater elongations of lead alloy slit segments, e.g., up to about 30 percent, asymmetrical shaping of the lobes using a ratio which is less than 1:1 but not less than about 1:5 is preferred. The leading angle may be in the range 30° to 85°.

Figure 18:
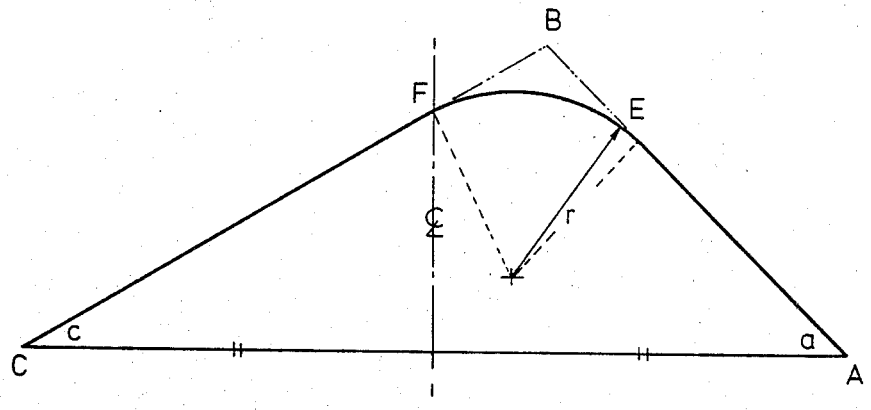
FIG. 18 geometrically illustrates a triangle incorporating the components of a tool surface employed according to the method and apparatus of the invention.

Although we are not bound by hypothetical considerations, we believe the relationship of leading angle, ratio of leading portion of triangle to trailing portion of triangle and radius of curve at the apex of the triangle relative to percent elongation can be expressed for triangular based tool shapes, with reference to FIG. 18, as follows:

$$\% E = \frac{(AE + EF\,\text{arc} + FC) - AC}{AC} \times 100 \quad (1)$$

$$\frac{AC}{\cos a\left(1 + \frac{\tan a}{\tan c}\right)} + \frac{AC}{\cos c\left(1 + \frac{\tan c}{\tan a}\right)} - 2\,r \tan\left(\frac{a + c}{2}\right) = AC\left(1 + \frac{\% E}{100}\right) \quad (2)$$

$$c = \sin^{-1}\left[\frac{AB}{BC} \sin a\right] \quad (3)$$

wherein:

%E=percent elongation
AC=slit length
a=leading angle
c=trailing angle
r=radius of curve at apex of triangle
AB/BC=ratio of leading portion of triangle to trailing portion of triangle The values of angles "a" and "c" can be calculated from equations (2) and (3) for various combinations of %E, AC, r and the ratio AB/BC.

Although much of the data was obtained from tests in which plasticine strip was used, comparative tests between plasticine and lead alloy conventionally used for battery grids, containing, e.g., 0.6% tin, 0.06% calcium and the balance lead, established that both materials functioned in the same manner within the scope of the tests.

The method and apparatus of the present invention have a number of important advantages as evidenced by the following conclusions which have been drawn from the foregoing data.

1. Use of symmetrical triangle-based slitting and preforming lobes with convexly curved apices produces more uniformly elongated segments than use of lobes which are arcs of circles.

2. Use of symmetrical rectangle-based lobes with convexly curved leading and trailing ends leads to excessive thinning at the trailing ends of segments. Provision of a linear tapered section at the trailing end decreases the thinning of elongated segments at this end.

3. Use of an asymmetrical triangle-based lobe having a convexly curved apex wherein the ratio of the length of the side of the triangle which is collinear with the leading linear portion of the lobe to the length of the side of the triangle which is collinear with the trailing linear portion of the lobe is greater than 1:1 leads to excessive thinning at the trailing end of an elongated segment.

4. Use of a preferred asymmetrical triangle-based lobe having a convexly curved apex wherein the ratio of the length of the side of the triangle which is collinear with the leading linear portion of the lobe to the length of the side which is collinear with the trailing portion of the lobe is less than 1:1 results in less trailing end thinning than that obtained with symmetrical triangle-based lobes. Use of symmetrical triangle-based lobes, i.e., a 1:1 ratio, results in less localized trailing end thinning than use of arcuate or semicircular lobes.

5. In the preferred configuration described above, a lobe having an apex with a small radius of curvature, e.g., the lobes of FIGS. 10 and 12, provides better distribution of elongation over the length of a segment than does a lobe wherein the radius of curvature of the apex is relatively large, e.g., the lobes of FIGS. 11 and 13. This radius, which is less than about half the chord representing the length of strip being slit to provide linear lobe portions, should not be decreased to such an extent that breakage of slit segments due to sharp bending is likely to occur.

6. It is evident that, as the ratio decreases, the angle formed between the side of the triangle corresponding to the linear leading portion and the base approaches 90°. Also, as the length of the portion of the leading side of the triangle which comprises the leading linear portion of the lobe approaches zero, the lobe approaches a limiting shape resembling half a tear drop wherein the leading end of the rounded apex portion tangentially meets the leading end of the base substantially at 90°. Since, in the preferred asymmetrical triangle-based lobe described above, some thinning at the leading end of an elongated segment occurred with a 1:2.5 ratio, it is preferred that this ratio be not less than about 1:5. It is evident from FIGS. 11–13 that choice of small ratio should be accompanied by choice of an apex having a small radius of curvature.

7. In the said preferred configuration, the optimum lobe has a triangle side ratio of leading end to trailing end which is about 1:1.5 and also has a small radius of curvature in the convexly curved apex portion.

In general, slitting and preforming to provide meshes with elongated segments having most uniform thickness throughout their length is effected by use of rotating discs provided with asymmetrical triangle-based lobes having linear leading and trailing portions spaced by convexly curved apices wherein, in each lobe, the ratio of the length of the side of the triangle which is collinear with the leading linear portion to the length of the side of the triangle which is collinear with the trailing linear portion is less than 1:1. More uniform thinning is achieved between the apex of a preformed segment and its trailing end than is obtained with lobes having corresponding side ratios equal to or greater than 1:1 as shown in FIGS. 5 and 14 to 17. It is also desirable that the radius of curvature of the curved apex be small, thereby providing a curved apex portion which is relatively short when compared to the combined lengths of the linear portions. Since initiation of some localized excess thinning at the leading end occurs when the ratio is decreased to 1:2.5, a ratio between 1:1 and 1:2.5 is preferred for 22% elongation. This thinning is due at least in part to choice of an apex having a relatively large radius.

With the formation of uniformly thinned elongated segments during the slitting and preforming of lead or lead alloy strip prior to lateral expansion to provide a network of meshes suitable for battery grids, the slitting and preforming operation and the lateral expansion can be carried out at relatively high speeds. For example, by the use of preferred asymmetrical triangle-based lobes as described to provide 22 percent elongation expanded mesh sheet was made from 1.27 mm thick strip at a rate of 58 meters per minute with substantially no breakage of elongated wires.

What we claim as new and desire to protect by Letters Patent of the United States is:

1. A method of forming elongated slit segments in deformable strip comprising concurrently slitting and preforming said strip by intermeshing, substantially convexly shaped tool surfaces each having a linear leading portion and a linear trailing portion joined by a rounded apex portion, said linear leading and trailing portions collinear with and generally defining portions of the sides of a triangle having a base wherein said base has a length equal to the length of the strip being slit and the length of the side of the triangle corresponding to and collinear with the leading portion is less than the length of the side of the triangle corresponding to and collinear with the trailing portion and the angle formed between the said side of the triangle corresponding to the leading portion and the base is not greater than 90°.

2. A method as claimed in claim 1 in which the length of the side of the triangle corresponding to the leading linear portion of each convexly shaped tool surface approaches zero and the leading end of the rounded apex portion meets the leading end of the base substantially at 90°.

3. A method as claimed in claim 1 in which the length of the side of the triangle corresponding to the leading portion relative to the length of the side of the triangle corresponding to the trailing portion has a ratio between 1:1 and 1:10.

4. A method as claimed in claim 1 in which the length of the side of the triangle corresponding to the leading portion relative to the length of the side of the triangle corresponding to the trailing portion has a ratio between 1:1 and 1.5.

5. A method as claimed in claim 3, or 4 in which the rounded apex portion has a radius of curvature less than half the length of the base.

6. A method as claimed in claim 3 or 4 in which the angle formed between the side of the triangle corresponding to the leading portion relative to the base is in the range of from about 30° to about 85°.

7. An apparatus for forming elongated slit segments in deformable strip comprising a pair of opposed rolls each having a plurality of equispaced discs having circumferential, equally spaced, convexly shaped tool surfaces alternating with substantially flat surfaces whereby peripheral surfaces of opposing rolls are adapted to interact on deformable strip passing therebetween to slit and preform segments in said strip by intermeshing of said convexly shaped tool surfaces and to define continuous lateral unslit bands by said substantially flat surfaces, said convexly shaped tool surfaces each having a linear leading portion and a linear trailing portion joined by a rounded apex portion, said linear leading and trailing portions generally defining and collinear with the sides of a triangle having a base wherein said base has a length equal to the length of the strip being slit and the length of the side of the triangle corresponding to the leading portion is less than the length of the side of the triangle corresponding to the trailing portion and the angle formed between the side of the triangle corresponding to the leading portion and the base is not greater than 90°.

8. An apparatus as claimed in claim 7 in which the length of the side of the triangle corresponding to the linear leading portion of each convexly shaped tool surface approaches zero and the leading end of the rounded apex portion meets the leading end of the base substantially at 90°.

9. An apparatus as claimed in claim 7 in which the length of the side of the triangle corresponding to the leading portion relative to the length of the side of the triangle corresponding to the trailing portion has a ratio of between 1:1 and 1:10.

10. An apparatus as claimed in claim 7 in which the length of the side of the triangle corresponding to the leading portion relative to the length of the side of the triangle corresponding to the trailing portion has a ratio between 1:1 and 1:1.5.

11. An apparatus as claimed in claim 9, or 10 in which the rounded apex portion has a radius of curvature less than half the length of the base.

12. An apparatus as claimed in claim 9, or 10 in which the angle formed between the side of the triangle corresponding to the leading portion relative to the base is in the range of from about 30° to about 85°.

* * * * *